US007420191B2

(12) United States Patent
Cachoncinlle et al.

(10) Patent No.: US 7,420,191 B2
(45) Date of Patent: Sep. 2, 2008

(54) DISCHARGE RADIATION SOURCE, IN PARTICULAR UV RADIATION

(75) Inventors: Christophe Cachoncinlle, Orleans (FR); Rémi Dussart, Saint-Pryve-Saint Mesmin (FR); Claude Fleurier, Marcilly en Vilette (FR); Jean-Michel Pouvesle, Saint-Pryve-Saint Mesmin (FR); Eric Robert, Orleans (FR); Raymond Viladrosa, Darvoy (FR)

(73) Assignees: Centre National de la Recherche Scientifique (C.N.R.S.), Paris (FR); Universite d'Orleans, Orleans Cedex (FR)

( * ) Notice: Subject to any disclaimer, the term of this patent is extended or adjusted under 35 U.S.C. 154(b) by 215 days.

(21) Appl. No.: 10/519,552

(22) PCT Filed: Jun. 27, 2003

(86) PCT No.: PCT/FR03/02002

§ 371 (c)(1),
(2), (4) Date: Jul. 27, 2005

(87) PCT Pub. No.: WO2004/003964

PCT Pub. Date: Jan. 8, 2004

(65) Prior Publication Data

US 2005/0285048 A1 Dec. 29, 2005

(30) Foreign Application Priority Data

Jun. 28, 2002 (FR) ..... 02 08149

(51) Int. Cl.
*H01J 61/02* (2006.01)

(52) U.S. Cl. ..... 250/493.1; 250/492.2; 250/504 R; 250/426; 378/119; 315/111.21; 372/76; 372/69

(58) Field of Classification Search ..... 250/504 R, 250/493.1, 426, 492.2; 378/119; 315/111.21; 372/76, 69
See application file for complete search history.

(56) References Cited

U.S. PATENT DOCUMENTS 5,935,374 A * 8/1999 Ito et al. ..... 156/345.29

(Continued)

FOREIGN PATENT DOCUMENTS

EP 0 887 836 12/1998

(Continued)

OTHER PUBLICATIONS

Robert et al.: "Spectroscopic and energetic investigation of capillary discharges devoted to EUV production for new lithography generation" Emerging Lithographic Technologies V, Proceedings Of SPIE, vol. 4343, Aug. 2001, pp. 566-575, XP008018784 Bellingham, USA p. 566-p. 567.

*Primary Examiner*—Jack I. Berman
*Assistant Examiner*—Michael J Logie
(74) *Attorney, Agent, or Firm*—Young & Thompson

(57) ABSTRACT

The invention concerns a radiation source, comprising an anode (2), a cathode (3), an electric discharge gap (4) between the anode (2) and the cathode (3) and a gas input conduit (30) in the discharge gap (4). The gas input conduit (30) is electrically connected to the anode and the cathode. The invention is characterized in that the gas input conduit (30) is supplied with gas by a gas supply conduit (32), designed to form between its portion (42) connected to the gas input conduit (30) and another of its portions connected to a fixed potential, an electric impedance such that it counters the generation of electric discharges inside the gas input conduit (30).

18 Claims, 3 Drawing Sheets

U.S. PATENT DOCUMENTS

| | | | | |
|---|---|---|---|---|
| 6,621,199 | B1 * | 9/2003 | Parfeniuk et al. | 313/231.51 |
| 6,972,421 | B2 * | 12/2005 | Melnychuk et al. | 250/504 R |
| 2002/0014599 | A1 * | 2/2002 | Rauch et al. | 250/504 R |
| 2003/0068012 | A1 * | 4/2003 | Ahmad et al. | 378/119 |
| 2004/0062992 | A1 * | 4/2004 | Kajiura et al. | 429/231.8 |

FOREIGN PATENT DOCUMENTS

| | | | |
|---|---|---|---|
| EP | 1170982 | A1 * | 1/2002 |
| WO | WO 02/07484 | A2 * | 1/2002 |

* cited by examiner

DISCHARGE RADIATION SOURCE, IN PARTICULAR UV RADIATION

BACKGROUND OF THE INVENTION

The invention relates to a radiation source, and in particular a source of radiation in the ultraviolet or extreme ultraviolet spectral range.

One field of application of the invention relates to the production of ultraviolet radiation which is used in the production of integrated circuits by means of lithography.

The increase in the density of integration of integrated circuits necessarily leads to a reduction in the dimensions of the constituent parts thereof.

It is thus desirable to produce circuits which have constituent parts having dimensions of less than 70 nanometres by using ultraviolet radiation sources and this has resulted in the need to reduce the wavelength of the ultraviolet radiation produced by the sources to lower values of, for example, 13.5 nanometres.

There are a number of types of source which can emit in the extreme ultraviolet range: synchrotron sources, sources of radiation produced by laser and sources produced by electrical discharges.

The document "Spectroscopic and energetic investigation of capillary discharges devoted to EUV production for new lithography generation" by Eric Robert, Branimir Blagojevic, Rémi Dussart, Smruti R. Mohanty, Moulay M. Idrissy, Dunpin Hong, Raymond Viladrosa, Jean-Michel Pouvesle, Claude Fleurier and Christophe Cachoncinlle, "Emerging Lithographic Technologies V, Proceedings of SPIE" Vol. 4343 (2001) describes a source of radiation in the extreme ultraviolet range, by means of electrical discharges.

The discharge is produced between an anode and a cathode in a space which is filled with gas. The discharge energises the gas molecules which emit radiation in order to become de-energised.

One of the disadvantages of the discharge radiation sources is the low quantity of energy which they radiate.

SUMMARY OF THE INVENTION

The object of the invention is to provide a source of discharge radiation which allows the quantity of energy radiated to be increased.

To this end, the subject-matter of the invention is a radiation source comprising:

- an anode,
- a cathode,
- a space for electrical discharge between the anode and the cathode,
- a pipe for introducing gas into the discharge space, the gas inlet pipe being electrically connected to the anode or to the cathode,
- means for producing, in the gas provided in the discharge space, an electrical discharge which brings about the emission of the radiation towards the outside, characterised in that the gas inlet pipe is supplied with gas by a gas supply line which is arranged for forming, between the portion thereof which is connected to the gas inlet pipe and another portion thereof which is connected to a fixed potential, such an electrical impedance that the production of electrical discharges inside the gas inlet pipe is inhibited.

Inventors have found that, in known sources, the connection to the cathode of the pipe for introducing gas into the discharge space caused the appearance of a large number of discharges in the gas located in the inlet pipe and not in the discharge space, thus further reducing the quantity of energy radiated.

Owing to the invention, the number of parasitic electrical discharges in the gas which is located in the inlet pipe is reduced, or even eliminated, which increases the number of discharges which take place in the discharge space and consequently the quantity of energy radiated.

According to other features of the invention,

- the fixed potential and the anode are earthed and the gas inlet pipe is electrically connected to the cathode;
- the source further comprises a system for cooling the anode;
- the cooling system has a circulation of cooling fluid in or on the anode;
- the cooling fluid comprises water;
- or the cooling fluid comprises air;
- or the cooling fluid comprises oil;
- the electrical impedance formed by the gas supply line comprises an electrical inductance;
- the gas supply line comprises, between the portion thereof connected to the fixed potential and the portion thereof connected to the gas inlet pipe, an electrically conductive material and is wound in order to form the inductance;
- the gas supply line is wound against and with spacing from an electrically insulating assembly component of the source;
- the means for producing discharge in the discharge space comprise at least one charge storage capacitor which is electrically connected, by means of a first terminal, to the cathode and, by means of a second terminal, to a first terminal of at least one commutation capacitor which is electrically connected to the anode by means of the second terminal thereof, electrical commutation means being provided between the first and second terminals of the at least one commutation capacitor and a source of charge voltage being provided between the first and second terminals of the at least one commutation capacitor;
- the commutation means comprise a switch which is controlled in single-pulse mode;
- or the commutation means comprise a switch which is controlled in pulse mode at a repetition frequency less than or equal to 10 kHz;
- the source of charge voltage and the commutation means are such that the at least one charge storage capacitor is charged by the source of charge voltage shortly before the commutation of the commutation means;
- a plurality of charge storage capacitors are provided, the cathode comprises an annular portion which is connected to a central portion which is connected to the discharge space, and the charge storage capacitors are distributed around the central portion and are connected, by means of the first terminal thereof, to the annular portion and, by means of the second terminal thereof, to a conductor ring which is electrically connected to the first terminal of the at least one commutation capacitor;
- the anode comprises a frustoconical hole for the passage of the radiation emitted in the discharge space, the hole being connected, by means of the small base thereof, to the discharge space and, by means of the large base thereof, towards the outside in order to allow the radiation emitted in the discharge space to pass towards the outside;
- or the anode comprises a central cylindrical hole for the passage of the radiation emitted in the discharge space, the hole being connected to the discharge space in order to allow the radiation emitted in the discharge space to pass towards the outside;

the cathode comprises a central frustoconical hole for the passage of gas, the small base of which is connected to the discharge space and the large base of which is connected to the gas inlet pipe;

or the cathode comprises a central cylindrical hole for the passage of gas, which hole is connected, at one side, to the discharge space and, at the other side, to the gas inlet pipe.

BRIEF DESCRIPTION OF THE DRAWINGS

The invention will be better understood from a reading of the following description, given purely by way of non-limiting example with reference to the appended drawings, in which.

DESCRIPTION OF THE PREFERRED EMBODIMENTS

Figure 1:
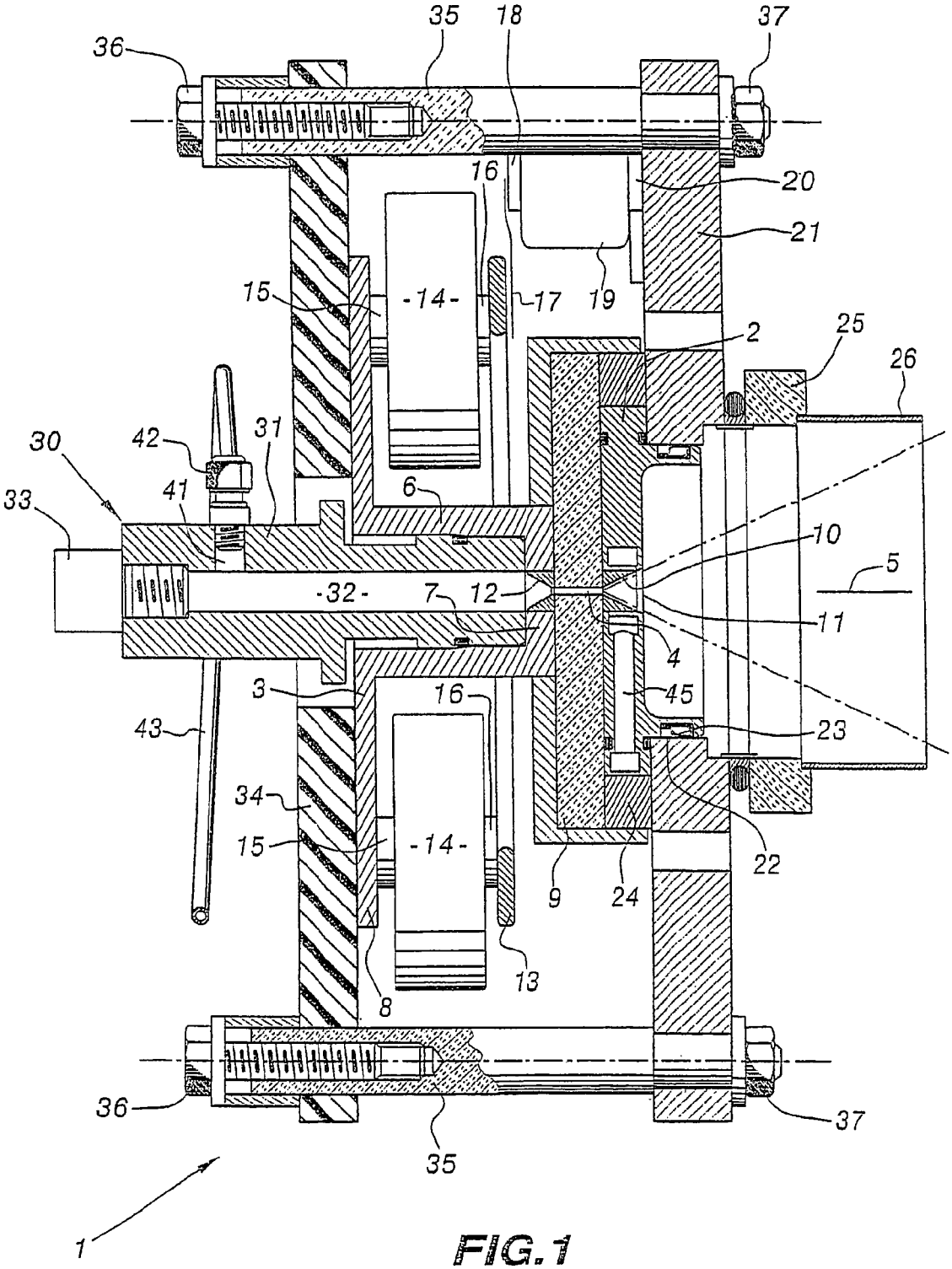
FIG. 1 is a schematic axially sectioned view of a radiation source according to the invention.

In the Figures, the source 1 of radiation according to the invention comprises an anode 2 and a cathode 3, both of which are electrically conductive and are separated from each other by means of a space 4 for electrical discharge.

The anode 2 is, for example, formed by a generally circular cylindrical metal component having a longitudinal axis 5, and the cathode 3 is, for example, formed by a metal component which is in the shape of a hat and which comprises a central portion 6 in the form of a circular cylindrical pot having an axis 5, whose base 7 is directed towards the discharge space 4 and whose open portion is connected to an annular portion 8 having an axis 5. The anode and/or the cathode are of conductive materials which have a high melting point, for example, 3% thoriated tungsten.

The discharge space 4 is, for example, formed by a capillary which is directed along the axis 5 and which is delimited transversely to the axis 5 by an electrically insulating disc 9 which is mounted between the base 7 of the portion 6 and the anode 2. The anode 2 comprises, at the centre thereof, a frustoconical hole 10 which has, for example, a half-angle of 25° at the top, and whose small base is connected to the discharge space 4 and whose large base 11 remote from the discharge space 4 and the disc 9 opens towards the outside in order to allow the radiation emitted by the discharge in the space 4 to pass. The base 7 of the cathode 3 also comprises a frustoconical hole 12 which has, for example, a half-angle of 25° at the top, and whose small base is connected to the discharge space 4 and whose large base is directed towards the annular portion 8. The holes 10 and 12 can also be cylindrical with axis 5. The disc 9 is, for example, of ceramic material and has a longitudinal thickness of from 0.1 to 40 mm and, for example, 10 mm.

An electrically conductive ring 13 having an axis 5 is fixed around the central portion 6, with spacing from the annular portion 8, so as to electrically insulate the portion 6. A plurality of charge storage capacitors 14 are arranged around, the central portion 6 and are connected, by means of the first electrical terminal 15 thereof, to the annular portion 8 and, by means of the second electrical terminal 16 thereof, to the ring 13. Furthermore, the ring 13 is connected, at a portion of the side thereof remote from the side which is connected to the terminals 16, to a conductor 17 for connecting to a first electrical terminal 18 of one or more commutation capacitors 19 which are connected by means of the second electrical terminal(s) 20 thereof to a conductive ring 21, for example, of steel, at the centre of which ring the anode 2 is mounted, the anode 2 being in electrical contact with the inner face 22 of the ring 21 by means of a contact element 23.

The electrical circuit for producing discharges in the space 4 is, for example, of the Blumlein type, as is known.

Electrical commutation means (not shown) are provided between the terminals 18 and 20 of the commutation capacitor 19 in order to connect the terminals to each other, the commutation means comprising, for example, a thyratron or any other suitable commutator and being controlled, for example, by means of an external generator which supplies current pulses at repetition frequencies which can be from 1 Hz to 10 kHz, in particular from 1 Hz to 5 kHZ, and, for example, equal to 1 kHz.

Between the terminals 18 and 20 of the commutation capacitor 19, there is provided, in parallel with the commutation means, a voltage source which is, for example, continuous and which has a value which can be in the order of up to 30 kV, or which is pulsed in accordance with a frequency of between 0.1 and 1 kHz and, for example, equal to 1 kHz.

Figure 2:
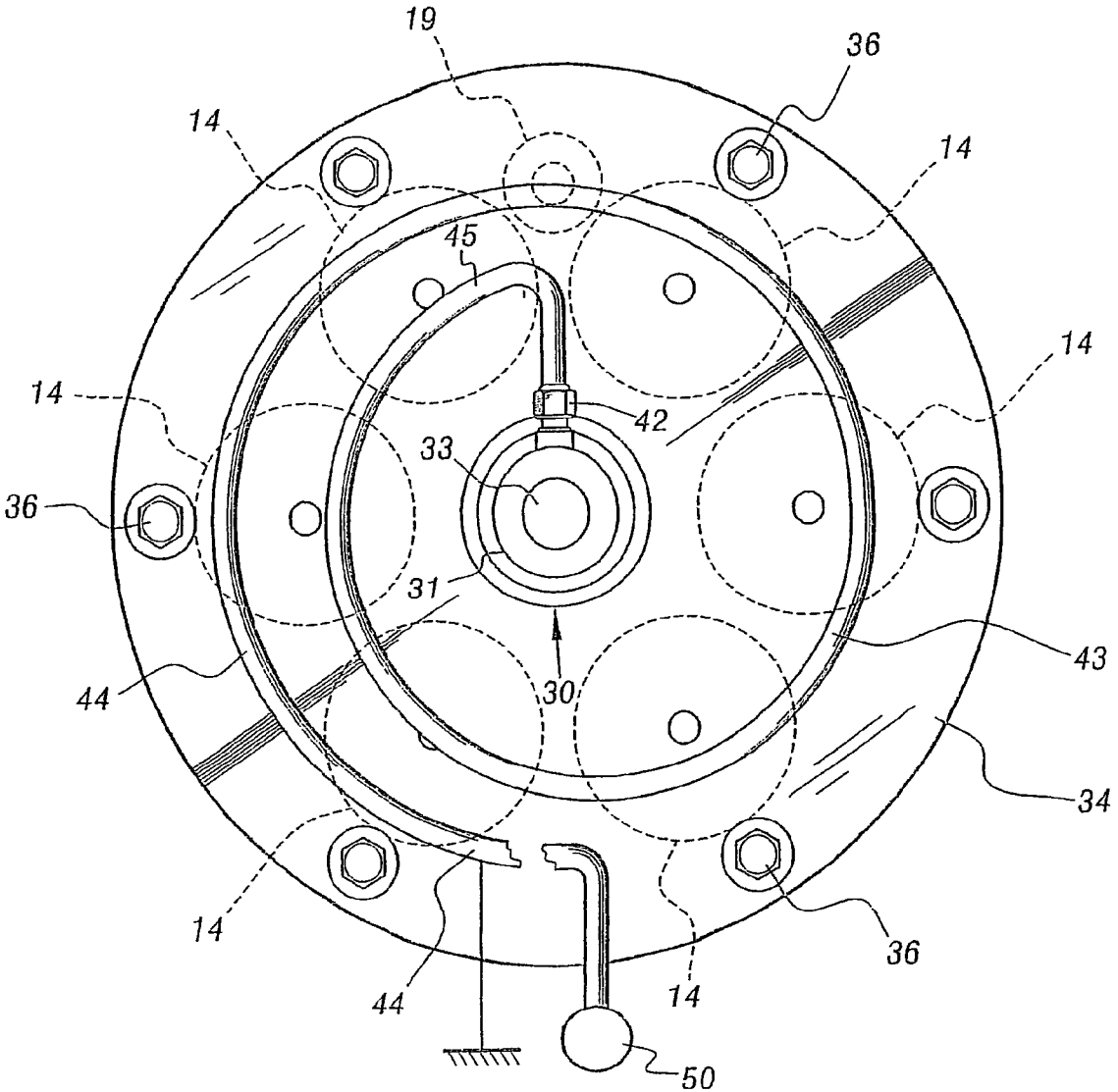
FIG. 2 is a schematic rear view of the source according to FIG. 1.

FIG. 2 illustrates six charge storage capacitors 14, each having a value of 4 nF which can support 20 kV. However, any number of capacitors 14 can be provided for an overall capacitance of between a few nF and some tens of nF and, for example, a single capacitor 14.

An electrically insulating centering ring 24 is mounted between the ring 21 and the disc 9 around the anode 2. A cylindrical piece 25 having an axis 5 is mounted in front of and at the centre of the ring 21 and comprises an outer opening 26 which allows the radiation originating from the hole 10 to pass.

A pipe 30 for introducing discharge gas into the discharge space 4 is mounted on the cathode 3, at the inner side of the central portion 6 thereof. The gas inlet pipe 30 comprises a longitudinal wall 31 which delimits a longitudinal circular cylindrical space 32 for the passage of gas, which terminates at one side in a gas-tight manner in the hole 12 and which is closed at the other side in a gas-tight manner by means of a plug 33 which is fixed in a gas-tight manner, for example, screwed, at the inner side of the wall 31.

An electrically insulating ring 34 is mounted against the annular portion 8 and the gas inlet pipe 30 extends through the centre thereof. The rings 21 and 34 are fixed to each other by means of rods 35 which are arranged around the above-mentioned elements and which are electrically insulating and are, for example, of PVC. Each rod 35 is fixed to the ring 34 and the ring 21 by means of longitudinal compression screws 36 and 37, respectively. The rings 21 and 34 are compressed longitudinally towards each other by means of the rods 35 in order to render the connections gas-tight between the gas inlet pipe 30 and the cathode 3, the cathode 3 and the discharge space 4, the discharge space 4 and the anode 2.

The wall 31 of the gas inlet pipe 30 comprises a transverse through-hole 41 which opens at one side in the space 32 for the passage of gas and into which a connector 42 for a discharge gas supply line 43 is inserted in a gas-tight manner at the other side.

The gas supply line 43 comprises a portion 44 which is remote from the connector 42 and which is connected to a fixed electrical potential.

The gas supply line 43 is connected, upstream of or at the portion 44 thereof, to a source 50 of discharge gas in order to direct the gas, via the line 43, the connector 42, the passage space 32 and the hole 12, into the discharge space 4. The connector 42 is electrically conductive and is of metal. The previous charging of the storage capacitors 14 followed by suitable control of the commutation means brings about the appearance of an electrical discharge in the gas provided in the discharge space 4 and the emission of radiation therein towards the hole 10 and the opening 26. The gas is, for example, xenon, nitrogen oxide, argon or krypton. The gas is, for example, selected in order to produce, by means of discharges, extreme ultraviolet radiation having a wavelength of between 10 and 50 nm and, for example, of 13.5 nm.

The gas supply line 43 is such that it defines, between the portion 44 thereof connected to the fixed potential and the portion 42 thereof connected to the gas inlet pipe 30, an electrical impedance which inhibits the production of electrical discharges inside the gas inlet pipe 30.

This fixed potential is, for example, earthed in the same manner as the anode, whilst the cathode has a lower potential than that of earth, which advantageously allows a cooling system to be provided by means of circulation of any cooling fluid in the body of the anode 2 or on the body thereof, whether the cooling fluid is electrically conductive or not. In FIG. 1, the cooling system of the anode 2 comprises a recess 45 in the body thereof in which the cooling fluid circulates. The invention thus offers the possibility of using a cooling fluid with good heat-exchange properties, such as water, which conducts electricity and which is inexpensive. The cooling fluid can be or can comprise water, air or oil.

The impedance formed by the gas supply line 43 between the portion 42 and the portion 44 thereof comprises, for example, an electrical inductance which is formed by the line 43 which is partially or completely of an electrically conductive material being wound between the portions 42 and 44 thereof. This winding is, for example, formed by the line 43 being turned slightly more than once from the portion 42 towards the portion 44 around the pipe 30. The line 43 is located with spacing from the ring 34 and the other components of the source 1 and is surrounded transversely with spacing by the rods 35 and the screws 36. The arrangement of the gas supply line 43 against the ring 34 and with spacing therefrom allows the spatial requirement thereof to be reduced.

Figure 3:
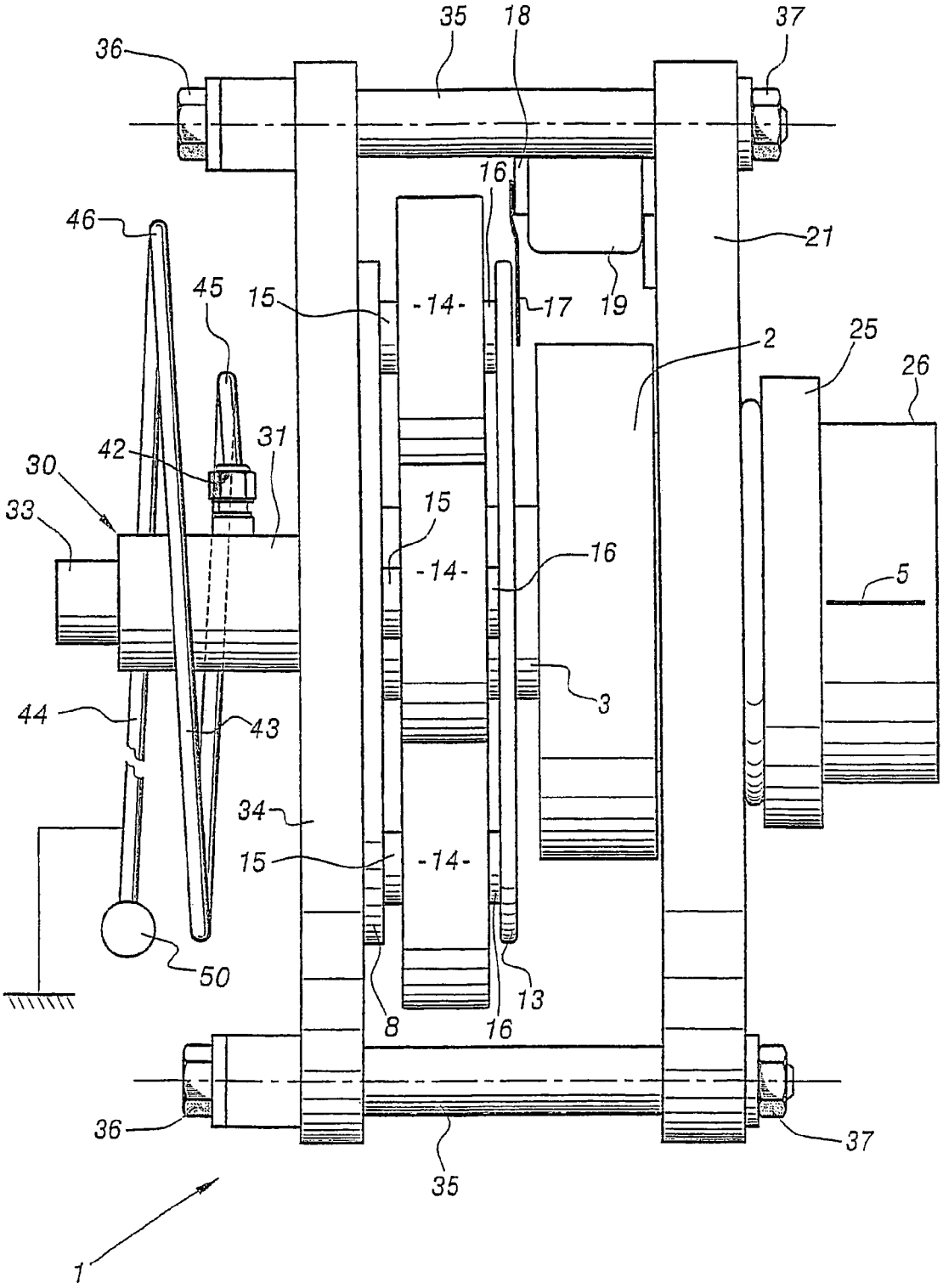
FIG. 3 is a schematic side view of the source according to FIGS. 1 and 2.

The winding of the gas supply line 43 can be in a helical or coil-like form or, as illustrated in FIG. 3, can have its inner portion 45, that is radially near the gas inlet pipe 30, longitudinally nearer the ring 34 than is its radially outer portion 46 that is remote from the pipe 30.

In this manner, the electrical inductance formed by the gas supply line 43 has a value which allows the electrical discharges to be eliminated in the gas inlet pipe 30. At the same time, the gas supply line 43 allows the electrical discharges to be prevented from appearing in the gas inlet pipe 30 and allows the gas inlet pipe 30 to be supplied with gas, thus making savings in terms of additional electrical components.

In this manner, the electrical energy which is supplied to the storage capacitors 14 in order to charge them is no longer wasted as parasitic electrical discharges in the gas inlet pipe 30, thus increasing the energy efficiency of the emission of radiation from the source with the same electrical supply.

Moreover, this efficiency is further increased by charging the storage capacitors only immediately or shortly before each commutation of the commutation means. This commutation can be carried out in single-pulse mode or in pulse mode up to 10 kHz.

The invention claimed is:

1. Radiation source comprising:

an anode (2);

a cathode (3, 8);

a discharge space (4) for electrical discharge between the anode (2) and the cathode (3);

a gas inlet pipe (30) for introducing gas into the discharge space (4), the gas inlet pipe (30) being electrically connected to one of the anode (2) and the cathode (3, 8);

an electrically insulating assembly (34) for the source;

means (13 to 23) for producing, in the gas provided in the discharge space (4), an electrical discharge which brings about emission of electromagnetic radiation towards outside the discharge space; and a gas supply line (43) that has a first portion (44) connected to a fixed potential and a second portion (42) connected to the gas inlet pipe (30) and that comprises, between the first portion and the second portion, an electrically conductive material, the gas supply line (43) being wound helically against and spaced from the electrically insulating assembly (34), so that production of electrical discharges inside the gas inlet pipe (30) is inhibited.

2. Radiation source according to claim 1, wherein the fixed potential and the anode (2) are earthed and the gas inlet pipe (30) is electrically connected to the cathode (3, 8).

3. Radiation source according to claim 2, wherein the cooling system (45) has a circulation of cooling fluid in or on the anode (2).

4. Radiation source according to claim 3, wherein the cooling fluid comprises water.

5. Radiation source according to claim 3, wherein the cooling fluid comprises air.

6. Radiation source according to claim 3, wherein the cooling fluid comprises oil.

7. Radiation source according to claim 1, further comprising a cooling system (45) for cooling the anode (2).

8. Radiation source according to claim 1, wherein the means (13 to 23) for producing discharge in the discharge space (4) comprise at least one charge storage capacitor (14) which is electrically connected, by means of a first terminal (15), to the cathode (3, 8) and, by means of a second terminal (16), to a first commutation capacitor terminal (18) of at least one commutation capacitor (19) which is electrically connected to the anode (2) by means of a second commutation capacitor terminal (20) thereof, electrical commutation means being provided between the first and second commutation capacitor terminals (18, 20) of the at least one commutation capacitor (19) and a source of charge voltage being provided between the first and second commutation capacitor terminals (18, 20) of the at least one commutation capacitor (19).

9. Radiation source according to claim 8, wherein the electrical commutation means comprise a switch which is controlled in single-pulse mode.

10. Radiation source according to claim 8, wherein the electrical commutation means comprise a switch which is controlled in pulse mode at a repetition frequency less than or equal to 10 kHz.

11. Radiation source according to claim 8, wherein the source of charge voltage and the electrical commutation means are arranged so that the at least one charge storage capacitor (14) is charged by the source of charge voltage shortly before the commutation of the electrical commutation means.

12. Radiation source according to claim 1, wherein the anode (2) comprises a frustoconical hole (10) for passage of the electromagnetic radiation emitted in the discharge space (4), the hole being connected, by means of the small base thereof, to the discharge space (4) and, by means of the large base thereof, towards the outside in order to allow the radiation emitted in the discharge space (4) to pass towards the outside.

13. Radiation source according to claim 1, wherein the anode (2) comprises a central cylindrical hole for the passage of the electromagnetic radiation emitted in the discharge space (4), the hole being connected to the discharge space (4) in order to allow the radiation emitted in the discharge space (4) to pass towards the outside.

14. Radiation source according to claim 1, wherein the cathode (3, 8) comprises a central frustoconical hole (12) for the passage of gas, the small base of which is connected to the discharge space (4) and the large base of which is connected to the gas inlet pipe (30).

15. Radiation source according to claim 1, wherein the cathode (3, 8) comprises a central cylindrical hole for the passage of gas, which hole is connected, at one side, to the discharge space (4) and, at the other side, to the gas inlet pipe (30).

16. Radiation source according to claim 1, wherein the gas supply line (43) is wound helically around the gas inlet pipe (30) in one plane that is generally perpendicular to an axis of the gas inlet pipe, the second portion being radially exterior and the first portion being radially interior in the one plane.

17. Radiation source comprising:

an anode (2);

a cathode (3, 8);

a discharge space (4) for electrical discharge between the anode (2) and the cathode (3);

a gas inlet pipe (30) for introducing gas into the discharge space (4), the gas inlet pipe (30) being electrically connected to one of the anode (2) and the cathode (3, 8);

means (13 to 23) for producing, in the gas provided in the discharge space (4), an electrical discharge which brings about emission of radiation towards outside the discharge space; and a gas supply line (43) having a first portion (42) connected to the gas inlet pipe (30) and a second portion (44) that is connected to a fixed potential, the gas supply line (43) forming, between the first portion (42) and the second portion (44), an electrical impedance so that production of electrical discharges inside the gas inlet pipe (30) is inhibited, wherein the means (13 to 23) for producing discharge in the discharge space (4) comprise at least one charge storage capacitor (14) which is electrically connected, by means of a first terminal (15), to the cathode (3, 8) and, by means of a second terminal (16), to a first commutation capacitor terminal (18) of at least one commutation capacitor (19) which is electrically connected to the anode (2) by means of a second commutation capacitor terminal (20) thereof, electrical commutation means being provided between the first and second commutation capacitor terminals (18, 20) of the at least one commutation capacitor (19) and a source of charge voltage being provided between the first and second commutation capacitor terminals (18, 20) of the at least one commutation capacitor (19), and wherein a plurality of charge storage capacitors (14) are provided, the cathode (3, 8) comprises an annular portion (8) which is connected to a central portion (6) which is connected to the discharge space (4), and the charge storage capacitors (14) are distributed around the central portion (6) and are connected, by means of the first terminal (15) thereof, to the annular portion (8) and, by means of the second terminal (16) thereof, to a conductor ring (13) which is electrically connected to the first commutation capacitor terminal (18) of the at least one commutation capacitor (19).

18. Radiation source comprising:

an anode (2);

a cathode (3, 8);

a discharge space (4) for electrical discharge between the anode (2) and the cathode (3);

a gas inlet pipe (30) for introducing gas into the discharge space (4), the gas inlet pipe (30) being electrically connected to one of the anode (2) and the cathode (3, 8);

means (13 to 23) for producing, in the gas provided in the discharge space (4), an electrical discharge which brings about emission of radiation towards outside the discharge space; and a gas supply line (43) wound helically around the gas inlet pipe (30) in one plane that is generally perpendicular to an axis of the gas inlet pipe, the gas supply line having a radially interior portion (42) connected to the gas inlet pipe (30) and a radially exterior portion (44) that is connected to a fixed potential, so that production of electrical discharges inside the gas inlet pipe (30) is inhibited.

* * * * *